US006028502A

United States Patent [19]

McSwiggen

[11] Patent Number: 6,028,502

[45] Date of Patent: Feb. 22, 2000

[54] POTENTIOMETER DETENT

[75] Inventor: John P. McSwiggen, Elmhurst, Ill.

[73] Assignee: Knowles Electronics, Inc., Itasca, Ill.

[21] Appl. No.: 09/324,438

[22] Filed: Jun. 2, 1999

[51] Int. Cl.[7] ..... H01C 10/32

[52] U.S. Cl. ..... 338/167; 338/190; 338/162; 200/11 K; 200/11 G

[58] Field of Search ..... 338/73, 68, 118, 338/135, 160, 162, 163, 167, 190; 200/11 G, 11 K, 180

[56] References Cited

U.S. PATENT DOCUMENTS

| | | | |
|---|---|---|---|
| 2,632,830 | 3/1953 | Aust et al. | 338/171 |
| 3,445,802 | 5/1969 | Spaude | 338/167 |
| 3,533,043 | 10/1970 | Spaude | 338/167 |
| 3,970,986 | 7/1976 | Seyler et al. | 338/167 |
| 5,745,025 | 4/1998 | Reuss | 338/167 |
| 5,773,774 | 6/1998 | Ramamurthy | 338/162 |

*Primary Examiner*—Michael L. Gellner
*Assistant Examiner*—Karl Easthom
*Attorney, Agent, or Firm*—Wallenstein & Wagner, Ltd.

[57] ABSTRACT

A potentiometer is disclosed that provides a user with tactile feel while making adjustments. The potentiometer includes a housing having a central bore with a rotor extending therein. A knob having a protrusion is operably connected to the rotor along with a wiper. A detent member having a lobe attachment segment and a fixed segment is operably connected to the housing. The lobe is deflected by the knob protrusion while the ring is compressed by forcing the lobe attachment segment towards said fixed segment. Furthermore, attached to the housing is a base plate carrying a resistive strip engaged by the wiper.

12 Claims, 5 Drawing Sheets

POTENTIOMETER DETENT

TECHNICAL FIELD

The present invention generally relates to an apparatus and a method for providing a user with tactile feel while making adjustments to a potentiometer, and in particular to a potentiometer having a resilient detent for providing the user with positioning feedback.

BACKGROUND OF THE INVENTION

Potentiometers find use in a variety of applications where a variable electrical resistance between input and output terminals is desired. Such uses include volume control, light control, instrumentations control, and the like. Most potentiometers include a housing in which a rotor turns, the rotor including electrical contacts that wipe across a resistive strip of a variable resistor.

To provide tactile feel when turning the potentiometer to positions such as off and on, many potentiometers use a detent. However, the detents used in the prior art fail to provide adequate tactile feel after an extended period of use.

SUMMARY OF THE INVENTION

The present invention is an apparatus and a method that provides a user with tactile feel while making adjustments to a potentiometer. The potentiometer includes a housing having a central bore with a rotor extending therein. A knob having a protrusion is operably connected to the rotor along with a wiper. A detent member having a lobe attachment segment and a fixed segment is operably connected to the housing. The lobe is deflected by the knob protrusion while, simultaneously, the ring is compressed by forcing the lobe attachment segment towards said fixed segment. Furthermore, attached to the housing is a base plate carrying a resistive strip engaged by the wiper.

BRIEF DESCRIPTION OF THE DRAWINGS

In the accompanying drawings forming part of the specification, and in which like numerals are employed to designate like parts throughout the same.

DETAILED DESCRIPTION

Figure 1:
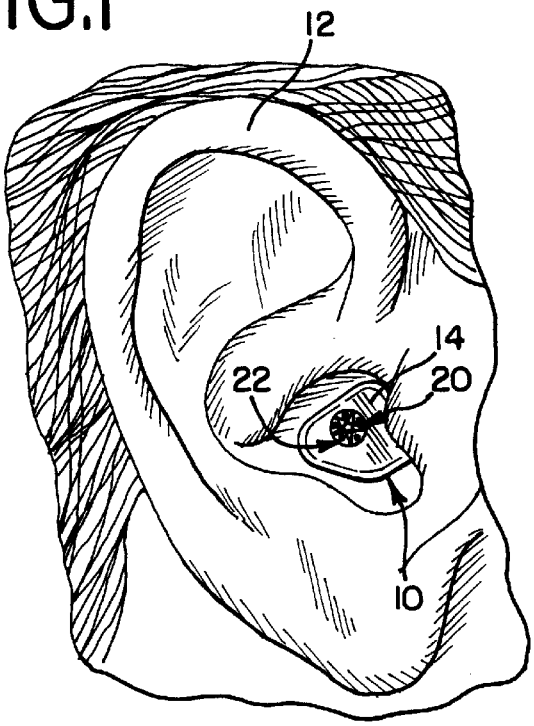
FIG. 1 is a perspective view of an application for a potentiometer in accordance with the present invention wherein the inventive potentiometer is shown in a hearing aid positioned in an ear.
Figure 2:
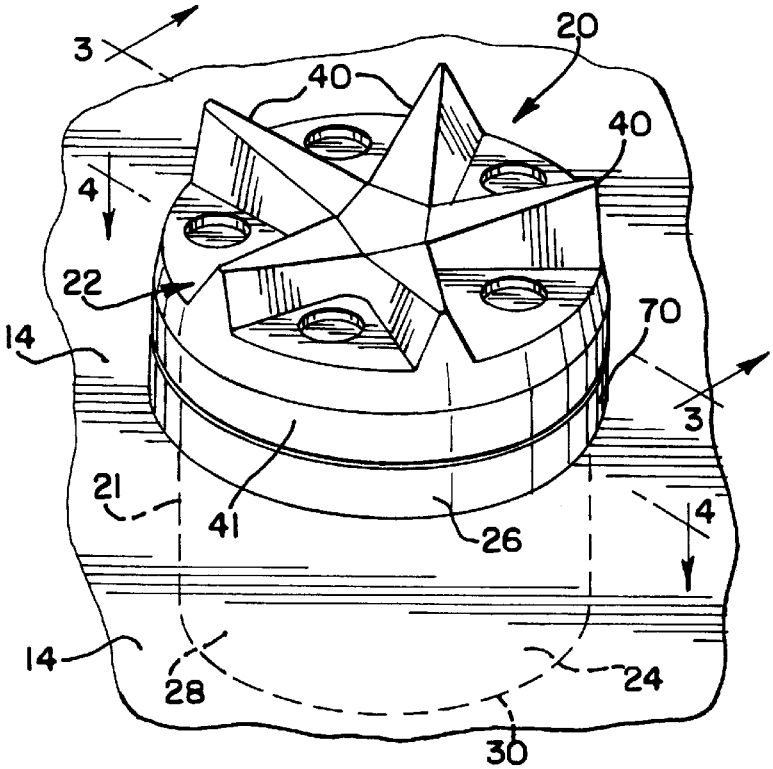
FIG. 2 is a partial perspective view of the hearing aid of FIG. 1 with the portion of the potentiometer within the hearing aid depicted partially in phantom.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring to FIG. 1, a potential environment is depicted for a potentiometer in accordance with the present invention. In particular, a hearing aid 10 is shown positioned in a person's ear 12. The hearing aid 10 comprises a hearing aid body 14 and a potentiometer 20. Hearing aid body 14 includes a battery and all of the necessary electric and electronic circuitry needed for the hearing aid 10 to function, with the exception of the circuitry needed to perform the function of the potentiometer 20 to be described hereinafter.

Referring now to FIGS. 2–7, an embodiment of the present invention having an improved detent is described. In broad detail, the potentiometer 20 shown in the FIGURES is disposed within a socket 21 in the hearing aid body 14. Potentiometer 20 includes a rotatable, manipulatable control knob 22 and a generally cylindrical housing 24 having integral top and bottom housing portions 26 and 28, respectively. Bottom housing portion 28 has an open bottom 30 that receives a baseplate 31, which in turn holds a resistive strip 32 having electrical contacts 33. A wiper 34 provides a varying resistive contact with the resistive strip held within the baseplate 32. Wiper 34 is held in place in part by a rotor 36 contained partially within a housing chamber 37 formed within housing 24. Rotor 36 in turn is operably attached to knob 22 so that it is jointly rotatable therewith.

Potentiometer 20 functions in a manner similar to known potentiometers in that rotation of knob 22 causes rotor 36 to rotate therewith, thereby moving wiper 34 across the resistive strip 32 contained within base plate 31 so as to vary the resistance between the electrical contacts 33 of the potentiometer. In this well known manner, the user can thus vary the volume of the hearing aid 10, for example, or the illumination in a lighting system, or other such application. Because the functioning of a potentiometer in this regard is well known in the art, a further explanation will not be provided herein. Further description of a potentiometer, a resistive strip, and how they function to vary the electrical output between the electrical contacts of the potentiometer can be found in many basic electrical device texts or, for example, in U.S. Pat. No. 4,803,458 to Trine et al.

Figure 4:
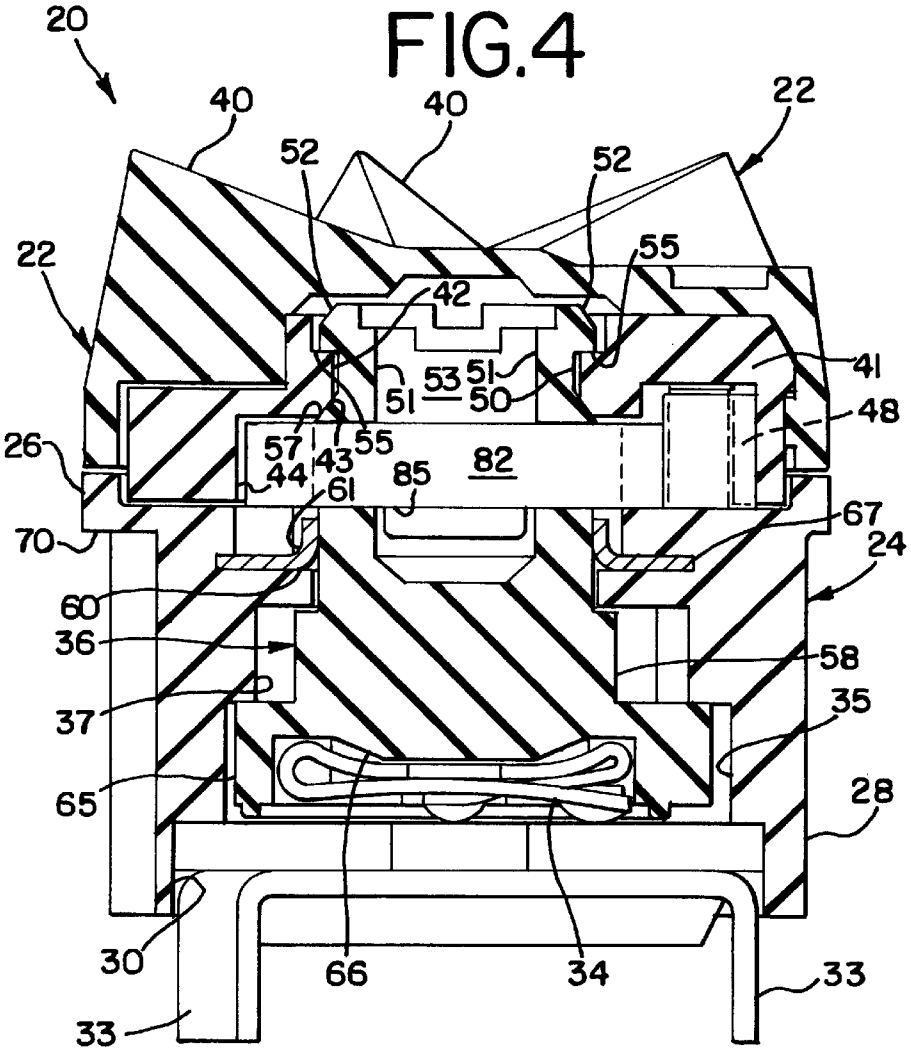
FIG. 4 is a cross sectional view of the potentiometer of FIG. 1 taken along plane 4—4 of FIG. 2.

With the foregoing explanation of the intended use of potentiometer 20, as well as the delineation of several major components thereof, a more detailed description of the potentiometer 20 will now be given. As can be seen in FIG. 4, in order to allow easy manipulation of the knob 22 of the potentiometer 20, a tolerance gap 38 is maintained between knob 22 and top housing portion 26. Knob 22 has a generally circular configuration and includes a plurality of upwardly extending flanges 40. Flanges 40 aid the user in the rotational manipulation of the knob 22. Knob 22 is attached to a generally annular base 41 having a central passage 42 in fluid communication with a funnel shaped portion 43, and a generally annular inner passage 44. Further, an outer lobe or protrusion 48 is integrally attached to the knob base 41 and extends into annular passage 44.

Central passage 42 slidingly but snugly receives a stem portion 50 of rotor 36. The stem 50 includes a pair of semi-cylindrical prongs 51 with the outer ends 52 of the prongs radially projecting outwards. Inserted between the prongs 51 is a plug 53 for maintaining the prongs in generally spaced parallel relationship to each other with a pair of slits 54 between the prongs. Further, the ends 52 of the prongs 51 engage an annular sill 55 defined within the central passage 42 of the knob base 41. Thus, the knob base 41 cannot be pulled free of rotor 36. Further, extending into annular passage 44 and integral with the knob base 41 are a pair of tabs 56 engaged within the slits 54 defined by the rotor prongs 51. This results in knob 22, knob base 41, and rotor 36 being jointly rotatable as a single rotatable structure.

Rotor 36 can be manufactured from a synthetic material such as a thermoplastic material. If desired, it can be fiber reinforced. As noted above, rotor 36 includes a stem 50 that extends outwardly beyond the housing 24. The prongs 51 of stem 50 define a frustum-like outer surface 57 longitudinally bisected by slits 54. The outer surface 57 engages funnel shaped portion 43 of the knob base 41. The stem 50 is attached, preferably integrally, to a column portion 58 of the rotor 36. Also, the proximal end 59 of stem 50 is substantially cylindrical to form a sealing surface 60 engaged by a sealing element 61. The sealing element 61 has a substantially annular disk-like configuration with a central aperture for receiving the rotor 38. As disclosed in U.S. Pat. No. 5,250,926 to McSwiggen, incorporated herein by reference, the sealing element prevents foreign material from entering the housing and interfering with the electrical connection between the wiper 34 and resistor element 32.

The column portion 58 of rotor 36 has protuberances 62 thereon that engage on/off switch contacts 63, 64 as knob 22 and thus rotor 36 are rotated. Potentiometer 20 functions in a known manner similar to other potentiometers having rotatable on/off switches and thus will not be described further. Rotor 36 further includes a base 65 having a countersunk portion 66 in which wiper 34 reposes as best seen in FIG. 4.

Figure 5:
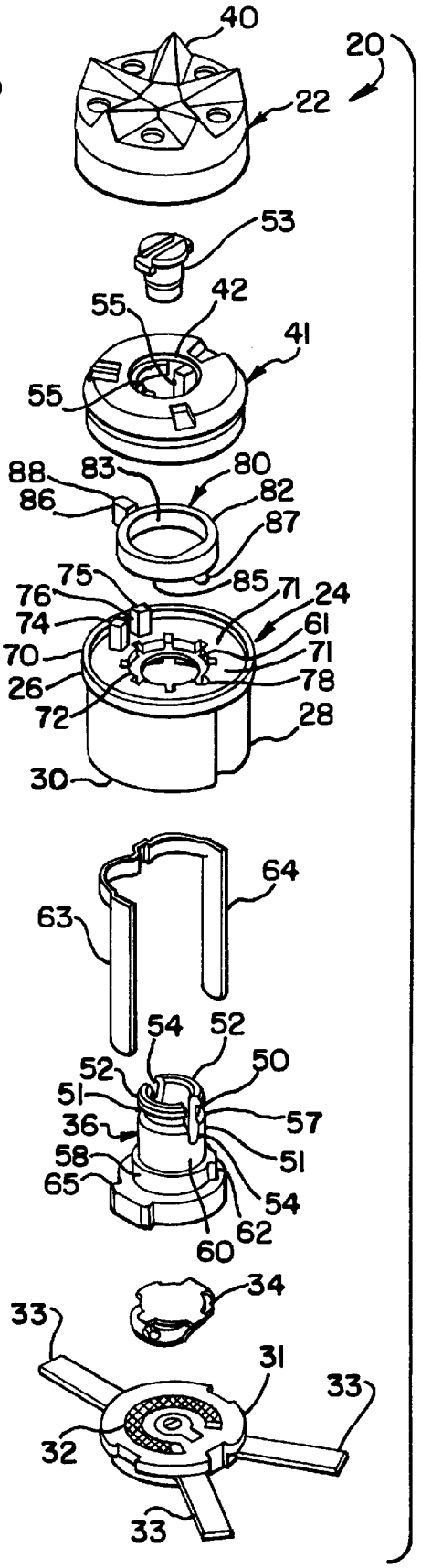
FIG. 5 is an exploded perspective view of the potentiometer of FIG. 1.
Figure 7:
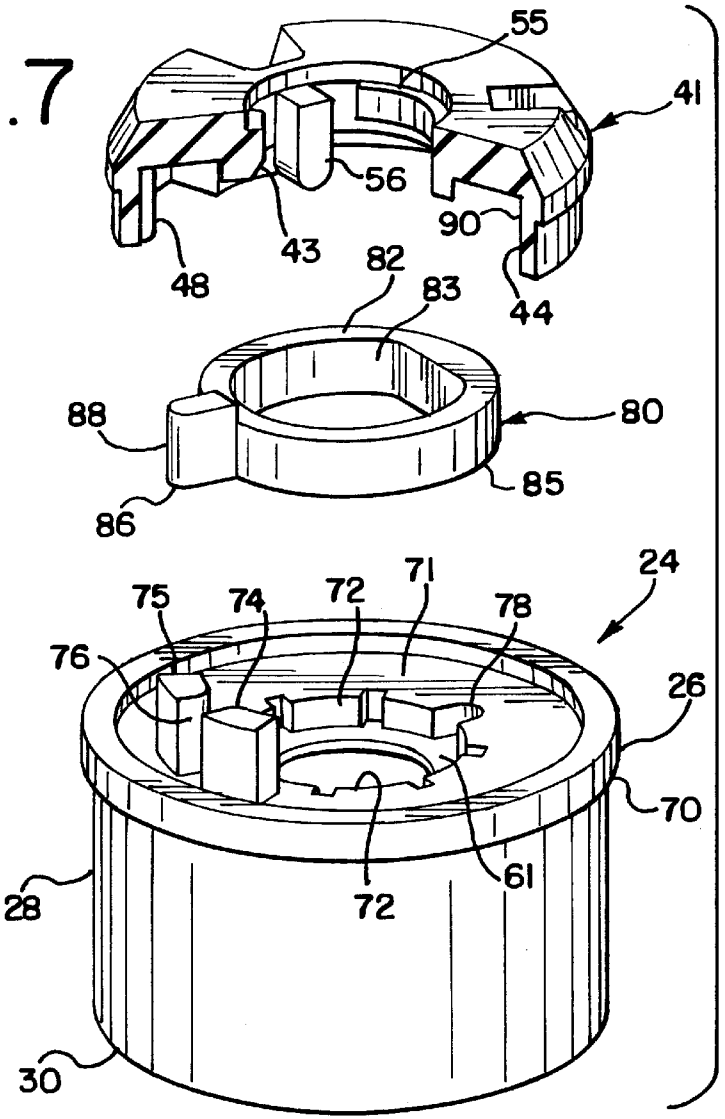
FIG. 7 is a partial exploded perspective view of the potentiometer of FIG. 1.
Figure 6:
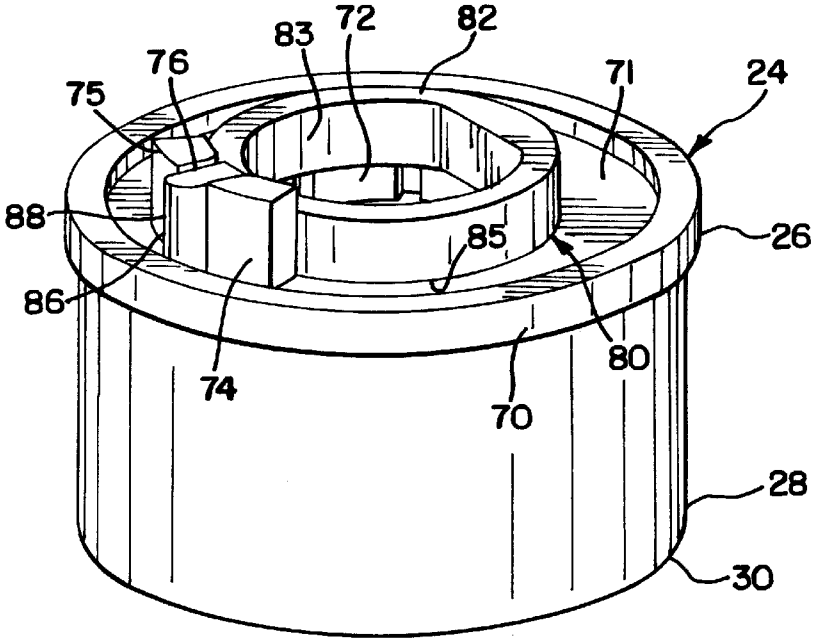
FIG. 6 is a perspective view of the potentiometer housing and detent of FIG. 3.

As shown in FIG. 4, housing 24 includes an inner annular groove 67 for receiving the outer circumference edge of sealing element 61. Turning to FIG. 5, the top portion 26 of the housing 24 includes an radially outward extending flange 70. The top portion 26 of the housing 24 also includes a planar annular top surface structure 71 having a centrally disposed passage 72 for receiving the stem 50 of rotor 36. Upwardly extending from the top planar surface 71 are a pair of walls or guide blocks 74, 75 having a spacing or gap 76 therebetween. Opposite the gap 76 and formed in the top surface 71 within center passage 72 is a notch 78.

Preferably, the guide blocks 74, 75 extending from the housing top surface 71 are received within the annular passage 44 of the knob base 41. Also contained within the annular passage 44 is a resilient detent member 80 having an endless resilient band or ring 82 with an outer radial surface 84, a planar bottom surface 85, and defining a center aperture 83 for receiving the stem 50 of rotor 36. Perpendicularly extending from a plane tangential to the outer radial surface 84 of band 82 is an inner lobe or detent protrusion 86 received within the gap 76 between walls 74 and 75. Also, a cylindrical post or locating peg 87 perpendicularly extends from the bottom surface 85 of the ring 82 and is received within the notch 78 in the housing top surface 71. Accordingly, where the detent protrusion 86 and the locating peg 87 extend from the ring 82 define a lobe attachment segment and a fixed segment of the ring, respectively.

The distal end 88 of the detent protrusion 86 is blunted and projects from between wall 74 and 75. Typically, the distal end 88 is proximate to the radial surface 90 of the annular passage 44 within the knob base 41.

Figure 3:
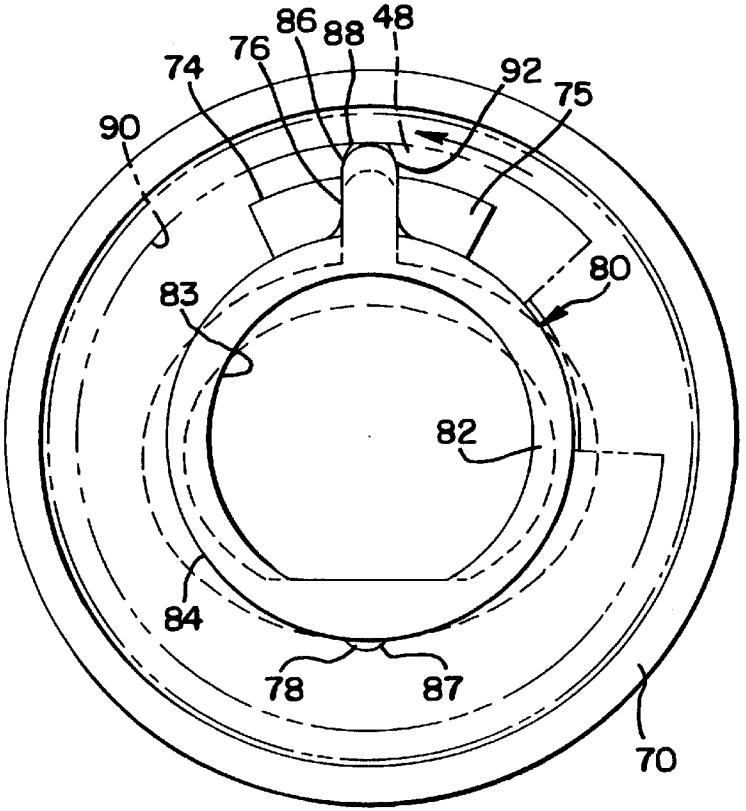
FIG. 3 is a partial cross sectional view of the potentiometer of FIG. 1 taken along plane 3—3 of FIG. 2 wherein the potentiometer includes a housing having a detent in accordance with the present invention operably attached thereto.

In operation, rotation of the knob base 41 by a user in the counterclockwise direction indicated by arrow 92 in FIG. 3, for example, results in like rotation of knob lobe 48. As the knob base 41 is rotated, knob lobe 48 comes into contact with detent 86. As the knob base 41 is further rotated in the counterclockwise direction, additional force is required to rotate the knob 22 as knob lobe 48 slides against and forces the detent 86 away from the radial surface 90 of the annular passage 44 within the knob base 41 as shown in phantom in FIG. 3. Retraction of detent 86 results in compressed deformation of the resilient band 82 into generally an elliptical shape wherein engaged post 87 maintains the position of the band opposite of detent 86. Further rotation of the knob base 41 in the counterclockwise direction results in movement of knob lobe 48 away from detent 86. This results in resilient band 82 being able to regain its generally cylindrical shape while projecting detent 86 towards the radial surface 90 of the annular passage 44 within the knob base 41. Accordingly, compression and decompression of the band as the knob 22 is rotated between predetermined on and off positions provides the user with a tactile sensation of the on and off positions of the potentiometer and thus the hearing aid 10.

As will be appreciated by those skilled in the art, the detent member 80 can be fabricated from a different material than the housing 24. The material used to fabricate the detent member 80 is related to the force necessary to deform the ring 82. Likewise, the thickness of the ring 82 relates to the amount of force required to deform the ring.

As indicated above, housing member 24 has a generally cylindrical outside configuration. Housing 24 includes a central bore 35 having a stepped internal configuration for receiving rotor 36. Thus, as shown in the FIGURES, housing bore 35 receives the rotor stem 50, column 58, and base 65.

Figure 9:
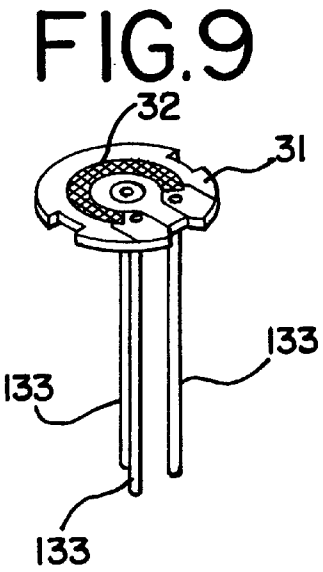
FIG. 9 is a perspective view of the punched base removed from the potentiometer of FIG. 8.
Figure 8:
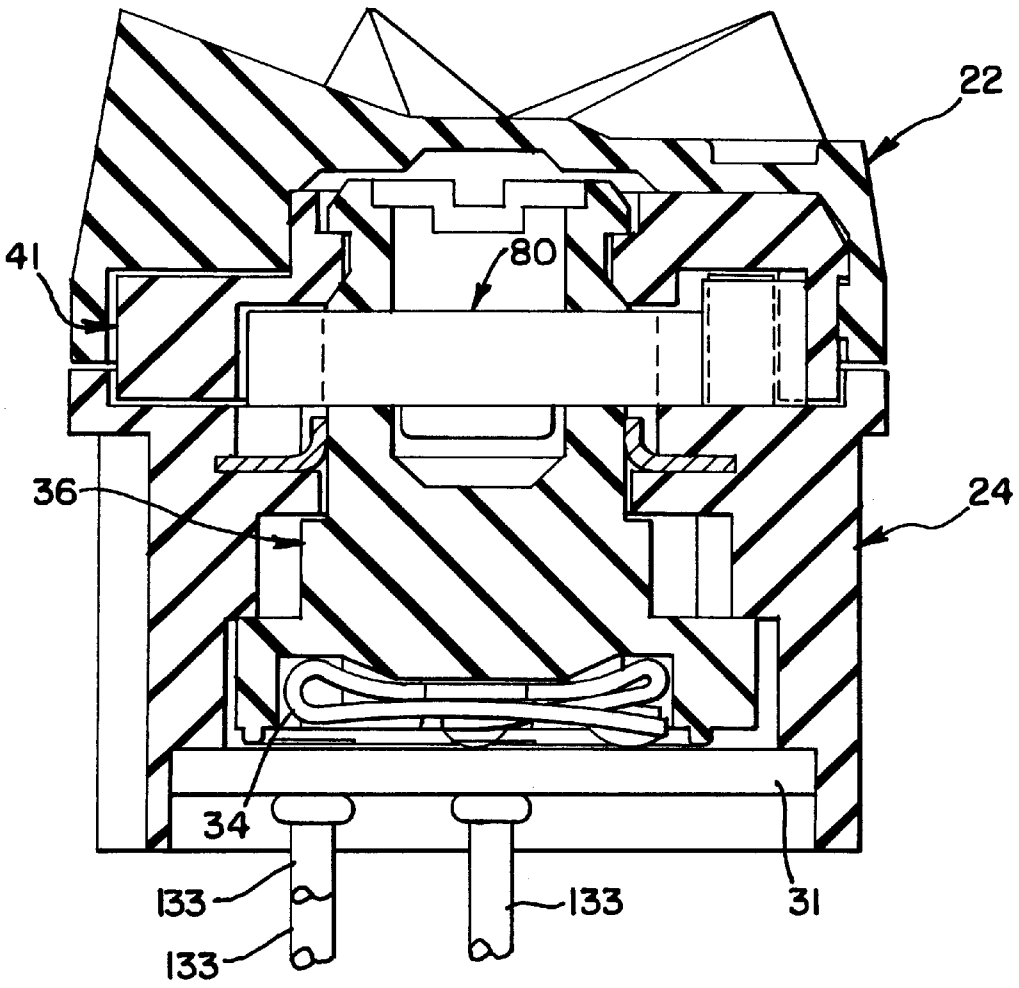
FIG. 8 is a cross sectional view of another embodiment of a potentiometer in accordance with the present invention having a punched base.

Turning to FIG. 8, a cross sectional view is provided of another embodiment of a potentiometer in accordance with the present invention. The potentiometer 120 is similar to that shown in FIGS. 1–7 except that a plurality of electrical conductive pins 133 extend from the punched base 31 instead of beam members extending from a baseplate. Accordingly, the last two digits in the one hundred series of reference numbers in FIGS. 8 and 9 are the same as the reference numbers to like elements depicted in FIGS. 1–7.

While the specific embodiment has been illustrated and described, numerous modifications come to mind without significantly departing from the spirit of the invention and the scope of protection is only limited by the scope of the accompanying claims.

I claim:

1. An apparatus comprising:

a housing having a central bore;

a rotor extending into said central bore;

a knob operably connected to said rotor and having a protrusion; and, a detent member having an annular spring and an lobe coupled together, said spring having a free segment and a fixed segment, said lobe radially deflected by said protrusion while said spring is compressed by forcing said free segment and said fixed segment closer together.

2. The apparatus of claim 1 wherein a wiper is operably attached to said rotor and a base plate is attached to said housing and carrying a resistive strip engaged by said wiper.

3. The apparatus of claim 1 wherein said housing includes an annular support surface having a passage and said rotor extends through said passage.

4. The apparatus of claim 3 wherein said annular support surface includes a notch.

5. The apparatus of claim 4 wherein said spring is generally annular and said fixed segment includes a registration pin engaged in said notch.

6. The apparatus of claim 1 wherein said housing includes at least one guide block and said lobe of said detent member slides against said guide block.

7. The apparatus of claim 1 wherein said fixed segment of said spring includes a registration pin engaged in a notch in said housing, and said lobe of said detent member is coupled to said free segment of said spring.

8. A potentiometer comprising:

a housing having a central bore;

a rotor extending within said central bore;

a knob having a base operably connected to said rotor and a protrusion extending from said base;

a detent member having a ring with a lobe extending therefrom, said ring having a lobe attachment segment and a fixed segment operably connected to said housing, said lobe radially deflected by said protrusion while said ring is compressed by forcing said lobe attachment segment towards said fixed segment;

a wiper operably attached to said rotor; and, a base plate attached to said housing and carrying a resistive strip engaged by said wiper.

9. The potentiometer of claim 8 wherein said housing includes an annular support surface having a passage, said rotor extends through said passage, and said detent member is mounted against said support surface.

10. The potentiometer of claim 9 wherein said annular support surface includes a notch.

11. The potentiometer of claim 10 wherein said fixed segment includes a registration pin engaged in said notch.

12. The potentiometer of claim 8 wherein said housing includes at least one guide block and said lobe of said detent member slides against said guide block.

* * * * *